US005116435A

United States Patent [19]

Nishimoto et al.

[11] Patent Number: 5,116,435

[45] Date of Patent: * May 26, 1992

[54] METHOD FOR PRODUCING NON-ORIENTED STEEL SHEETS

[75] Inventors: Akihiko Nishimoto; Yoshihiro Hosoya; Toshiaki Urabe, all of Tokyo, Japan

[73] Assignee: NKK Corporation, Tokyo, Japan

[*] Notice: The portion of the term of this patent subsequent to Jan. 21, 2009 has been disclaimed.

[21] Appl. No.: 330,926

[22] Filed: Mar. 27, 1989

Related U.S. Application Data

[63] Continuation-in-part of Ser. No. 101,721, Sep. 28, 1987, abandoned.

[30] Foreign Application Priority Data

Sep. 29, 1986 [JP] Japan ..... 61-228114

[51] Int. Cl.[5] ..... H01F 1/04

[52] U.S. Cl. ..... 148/111; 148/120

[58] Field of Search ..... 148/111, 113, 120, 112

[56] References Cited

U.S. PATENT DOCUMENTS

| | | | |
|---|---|---|---|
| 3,287,184 | 11/1966 | Koh | 148/307 |
| 3,867,211 | 2/1975 | Easton | 148/307 |
| 4,046,602 | 9/1977 | Stanley | 148/111 |

FOREIGN PATENT DOCUMENTS

| | | | |
|---|---|---|---|
| 0011473 | 2/1934 | Australia | 148/309 |
| 0263413A2 | 4/1988 | European Pat. Off. . | |
| 156651 | 9/1982 | Fed. Rep. of Germany | 148/306 |
| 1006119 | 1/1976 | Japan | 148/309 |
| 54-116321 | 9/1979 | Japan | 148/111 |
| 119652 | 6/1986 | Japan | 148/306 |
| 1139642 | 6/1986 | Japan | 148/307 |
| 63-83226 | 4/1988 | Japan . | |

*Primary Examiner*—John P. Sheehan

*Attorney, Agent, or Firm*—Frishauf, Holtz, Goodman & Woodward

[57] ABSTRACT

A method for producing a non-oriented electrical steel sheet with precise thickness and homogeneous magnetic property comprising the steps of: making a steel ingot which has: 0.01 wt. % or less C, 0.003 wt. % or less N, 0.01 to 1.0 wt. % Mn, Al and Si satisfying, in wt. %, the formulas of:

$$(\text{Al }\%) \leqq 0.69\ (\text{Si }\%)^2 - 2.29\ (\text{Si }\%) + 1.90;$$

$$(\text{Al }\%) \geqq 0.10\ (\text{Si }\%)^2 - 0.35\ (\text{Si }\%) + 0.3;$$

$$0 \leqq (\text{Si }\%) \leqq 1.7 \text{ wt. }\%; \text{ and } (\text{Al }\%) \geqq 0,$$

provided that (Si %) represents the Si (wt. %) and (Al %) represents Al content (wt. %), and the balance being Fe and inevitable impurities to produce a steel slab; hot-rolling the slab at a finishing temperature of 700° to 900° C. into a steel strip and coiling the hot rolled strip; and cold-rolling the hot-rolled strip into a cold-rolled strip, followed by annealing the cold-rolled strip.

15 Claims, 5 Drawing Sheets

FIG. 2
FIG. 2 (a)
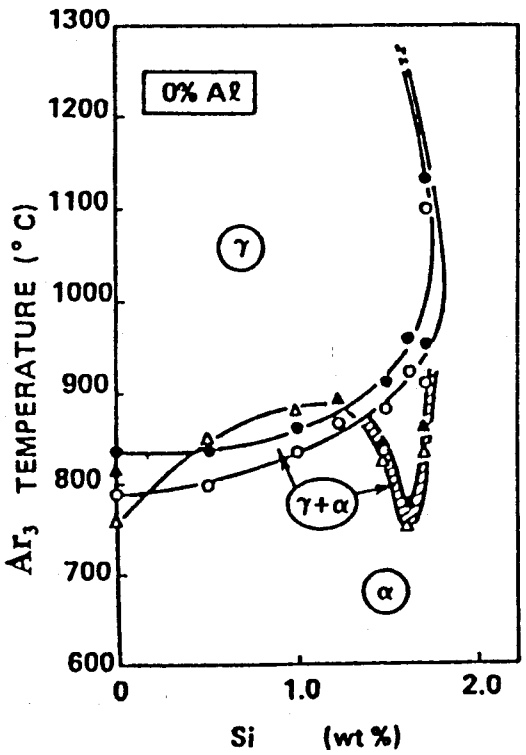
FIG. 2 (b)
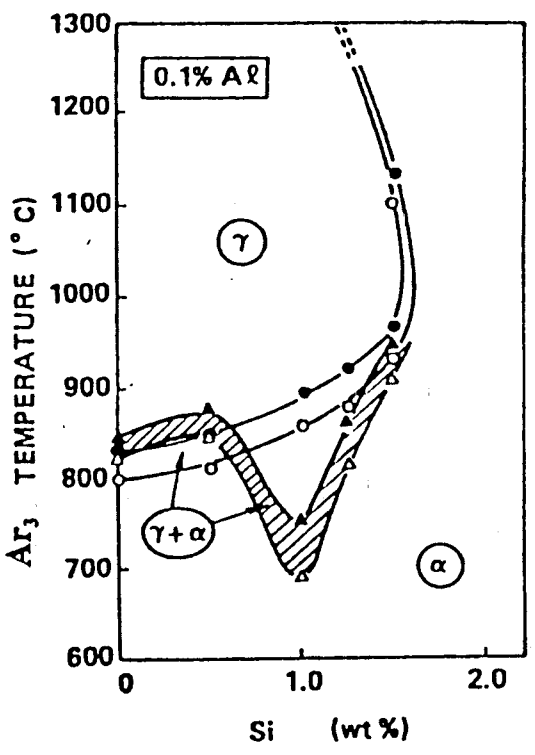
FIG. 2 (c)
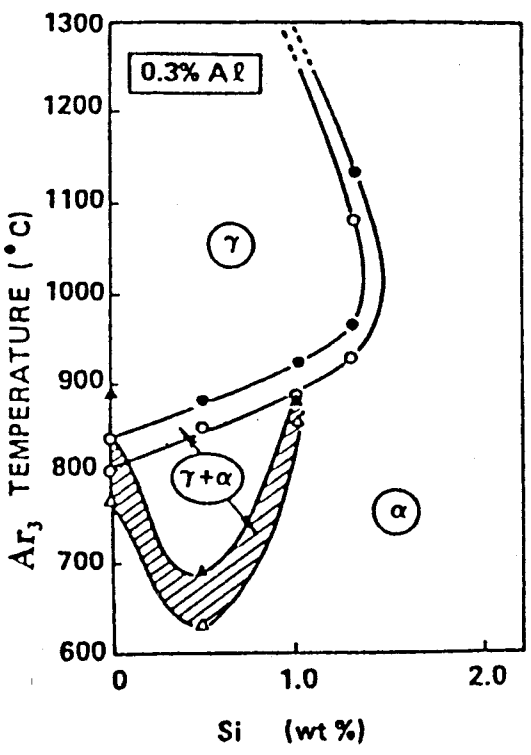

METHOD FOR PRODUCING NON-ORIENTED STEEL SHEETS

This application is a continuation-in-part of application Ser. No. 07/101,721, filed Sep. 28, 1987, now abandoned.

BACKGROUND OF THE INVENTION

1. Field of the Invention

The present invention relates to non-oriented electrical steel sheets and a method for producing non-oriented steel sheets, and more particularly to compositions of non-oriented electrical steel sheets and the conditions for hot-rolling thereof.

2. Description of the Prior Art

Non-oriented electrical steel sheets are widely used for core materials of electrical apparatus for example, a rotating machine. Recently, for increasing the efficiency of, reducing the weight of and compacting these electrical apparatuses, materials having low core loss and high magnetic flux density have been in demand.

Steel sheets to which silicon is added, so-called "silicon steel sheets," have been customarily used as non-oriented electrical steel sheets. The addition of Si to steel increases specific resistance and reduces core loss value. However, because Si is an element having a characteristic of allowing the $\alpha$-phase to be stabilized as shown in FIG. 1, the $Ar_3$ transformation point temperature of silicon steel is raised in compliance with addition of Si, and the $\gamma$-phase of the silicon steel closes its loop when the addition of Si reaches a certain amount. The $\gamma$-phase of extra low carbon steel which contains no Al closes its loop at approximately 1.7 wt % Si, while the critical Si-amount is decreased when Al is added to the extra-low carbon steel. Changes of $Ar_3$ transformation point temperatures in a range of 800° to 1,000° C. meet finishing temperatures at hot rolling. Therefore, hot rolling in the whole length at the $Ar_3$ transformation temperature range becomes more difficult as the Si addition amount is increased. That is to say, in the case of a steel containing 1.7 wt % Si as shown in FIG. 1, the $Ar_3$ transformation point temperature reaches 900° C. and more. For this reason, conventional methods do not permit finishing hot-rolling temperatures above their $Ar_3$ transformation points.

To overcome the difficulty the art has been forced to adopt high temperature heating. However, the means for heating Si contained steel sheets at high temperatures of 1,200° C. and more has a disadvantage in that the surface smoothness property of the Si contained steel sheets is deteriorated. This is because, when the silicon contained steel sheets are heated at high temperatures of 1,200° C. and more, slab surface scales are melted, exfoliative features of the slab surface scales before hot rolling are lowered, and scales rolled-in during the process of hot rolling.

Moreover, even if the finishing temperature is maintained at the $Ar_3$ transformation point or more, by lower temperature heating, the means still has a drawback that the magnetic property of the final products deteriorates, because, in this case, owing to edge portions of steel slabs being hot-rolled in the state of having ferrite and austenite dual phases, the thickness and structure of the edge portions of hot-rolled steel sheets become non-uniform, due to difference of deformation resistance of the two phases.

SUMMARY OF THE INVENTION

An object of the present invention is to provide non-oriented electrical steel sheets having a sharply precise thickness and a highly homogeneous magnetic property and a method for producing such non-oriented electrical steel sheets.

In accordance with the present invention, non-oriented electrical steel sheets are provided, comprising the contents of:

0.01 wt % and less C, 0.003 wt % and less N and 0.1 to 1.0 wt % less Mn;

Si and Al satisfying, in wt %, the formulas of:

$$(Al\ \%) \leqq 0.69\ (Si\ \%)^2 - 2.29\ (Si\ \%) + 1.90$$
$$(Al\ \%) \geqq 0.69\ (Si\ \%)^2 - 0.35\ (Si\ \%) + 0.3$$
$$(Si\ \%) \leqq 1.7\ wt\ \%;\ \text{and the balance}$$

being Fe and inevitable impurities. Furthermore, a method is provided for producing non-oriented electrical steel sheets comprising the steps of: making steel ingots comprising the contents of:

0.01 wt % and less C, 0.003% and less N, 0.1 to 1.0 wt % Mn, and 1.7 wt % and less Si; Si and Al satisfying, in wt %, the formulas of:

$$(Al\ \%) \leqq 0.69\ (Si\ \%)^2 - 2.29\ (Si\ \%) + 1.90$$
$$(Al\ \%) \geqq 0.10\ (Si\ \%)^2 - 0.35\ (Si\ \%) + 0.3;\ \text{and}$$

the rest being Fe and inevitable impurities;

hot-rolling steel slabs produced through slabbing the steel ingots, at finishing temperature of 700° to 900° C., into hot-rolled steel strips, to coil the hot-rolled steel strips;

cold-rolling the hot-rolled steel strips into cold-rolled steel strips, followed by annealing the cold-rolled steel strips.

Other objects and advantages of the present invention will become apparent from the detailed description to follow taken in conjunction with the appended drawings.

BRIEF DESCRIPTION OF THE DRAWINGS

FIG. 2 are three graphs (FIG. 2(*a*), FIG. 2(*b*), FIG. 2(*c*)) depicting a representation of a comparison of the $Ar_3$ transformation point of steel sheets of the present invention which have been worked with that of steel sheets which have not been worked.

DESCRIPTION OF THE PREFERRED EMBODIMENTS

It is preferable that non-oriented electrical steel sheets are produced at final annealing so as to have a good magnetic property and still be homogeneous. The magnetic property of steel sheets is greatly affected by their texture formed after annealing. Since this texture formed by annealing reflects a texture formed by hot rolling, the texture formed by hot rolling is a key point for improving magnetic property. Consequently, finish hot rolling is required to be completed in the state that the steel is allowed to be in the area of a single phase of austenite and to be of an homogeneous structure of ferrite.

In this connection, behavior of non-equilibrium transformation of Fe-Si-Al alloy have been pursued in detail with the results of the pursuance have been found as shown in FIG. 2.

FIG. 2 graphically shows the comparison of $Ar_3$ transformation points of steel sheets of the present invention which have been worked with that of steel sheets which have not been worked. In FIG. 2(*a*) shows 0% Al content, FIG. 2(*b*) 0.1% Al content and FIG. 2(*c*) 0.3% Al content. Symbol character ● represents a start point of transformation, and symbol character ○ a finish point of transformation, respectively in the case of the steel sheets which have not been worked. Symbol character ▲ represents a start point of transformation, and symbol character Δ a finish point of transformation, respectively in the case of steel sheets which have been worked. A steel sheet of a certain composition which has been worked marks a 100° C. decrease of the $Ar_3$ transformation point in comparison with the $Ar_3$ transformation point in equilibrium.

Figure 3:
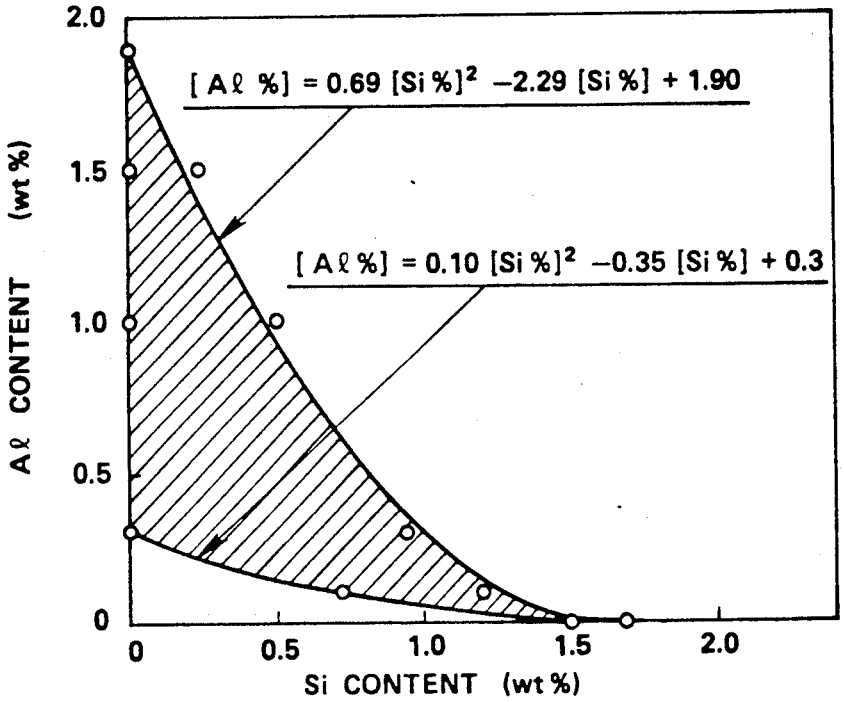
FIG. 3 is a graphic representation showing the Si-Al composition area where the austenite structure exists stably at 860° C.

FIG. 3 graphically shows the Si and Al composition area of the present invention where austenite exists stably even at 860° C. in a non-equilibrium diagram as shown in FIG. 2. Namely, in the area marked with a slanted line, the Si-and-Al composition is enough to form an homogeneous ferrite structure even if hot rolling is completed at a finishing temperature of 900° C. and less. Resultantly, if the finishing temperature can be ensured to be approximately 860° C., the slab heating temperature can be 1,000° to 1,150° C., thereby remelting of AlN precipitated at solidification of the steel is minimized and, still, the amount of solute N is reduced. In addition, improvement in the growth of grains contributes to increasing not only magnetic permeability, but also soft magnetism, such as reduction of coercive force. Furthermore, the remelting of slab surface scales is reduced, and, at the same time, the accuracy of the thickness of steel sheets is greatly improved owing to the steel sheets being wholly of an homogeneous ferrite structure.

Secondly, the reasons for limiting specifically chemical composition of electrical steel sheets will now be described.

In the case that C is contained in an amount more than 0.01 wt % in steel, the magnetic property of steel sheets is worsened, due to occurrence of magnetic aging when the steel sheets are used as products. For this reason, the C content of 0.01 wt. % and less is preferable.

When N is contained in an amount more than 0.0030 wt. % in steel, the magnetic property is worsened as well. Accordingly, the N content of 0.0030 wt. % and less is preferable.

Si is an important element for increasing specific resistance and reducing core loss. In the range of more than 1.7 wt. % Si content, however, stable hot-rolling in the austenite phase cannot be performed. Thus, the Si content is to be 1.7 wt. % and less.

In the present invention, beside those specific arrangements of chemical composition, another control of chemical composition is carried out. Like Si, Al is an effective element for improving magnetic property. Furthermore, in Al-Si contained steel, the relationship between Al and Si is controlled to satisfy formula (1) below, where ("Al") and ("Si"), each represents wt. % Al content and wt. % Si content respectively. Namely, the Al and Si contents are controlled so as to be within the slanted area in FIG. 3. A remarkable phenomenon that $Ar_3$ transformation point temperature is lowered appears.

If formulas (1) are satisfied austenite phase exists stably even at 860° C.

$$\left.\begin{aligned}(\text{Al }\%) &\leqq 0.69\ (\text{Si }\%)^2 - 2.29\,(\text{Si }\%) + 1.90\\ (\text{Al }\%) &\geqq 0.10\ (\text{Si }\%)^2 - 0.35\,(\text{Si }\%) + 0.3\end{aligned}\right\} \quad (1)$$

Moreover, if formulas (2) below are satisfied, the austenite phase exits stably even at 800° C.

$$\left.\begin{aligned}(\text{Al }\%) &\leqq 0.82\ (\text{Si }\%)^2 - 2.39\,(\text{Si }\%) + 1.76\\ (\text{Al }\%) &\geqq 0.15\ (\text{Si }\%)^2 - 0.46\,(\text{Si }\%) + 0.36\end{aligned}\right\} \quad (2)$$

If formulas (3) and (4), each, are satisfied, the austenite phase exists stably, respectively, at 750° C. and 700° C.

$$\left.\begin{aligned}(\text{Al }\%) &\leqq 0.80\ (\text{Si }\%)^2 - 2.28\,(\text{Si }\%) + 1.60\\ (\text{Al }\%) &\geqq 0.18\ (\text{Si }\%)^2 - 0.46\,(\text{Si }\%) + 0.38\end{aligned}\right\} \quad (3)$$

$$\left.\begin{aligned}(\text{Al }\%) &\leqq 0.92\ (\text{Si }\%)^2 - 2.14\,(\text{Si }\%) + 1.25\\ (\text{Al }\%) &\geqq 0.10\ (\text{Si }\%)^2 - 0.40\,(\text{Si }\%) + 0.43\end{aligned}\right\} \quad (4)$$

Consequently, in compliance with formulas (1) to (4), if the austenite phase is allowed to exist stably at a lower temperature, hot-rolling can be at such lower temperature.

Figure 4:
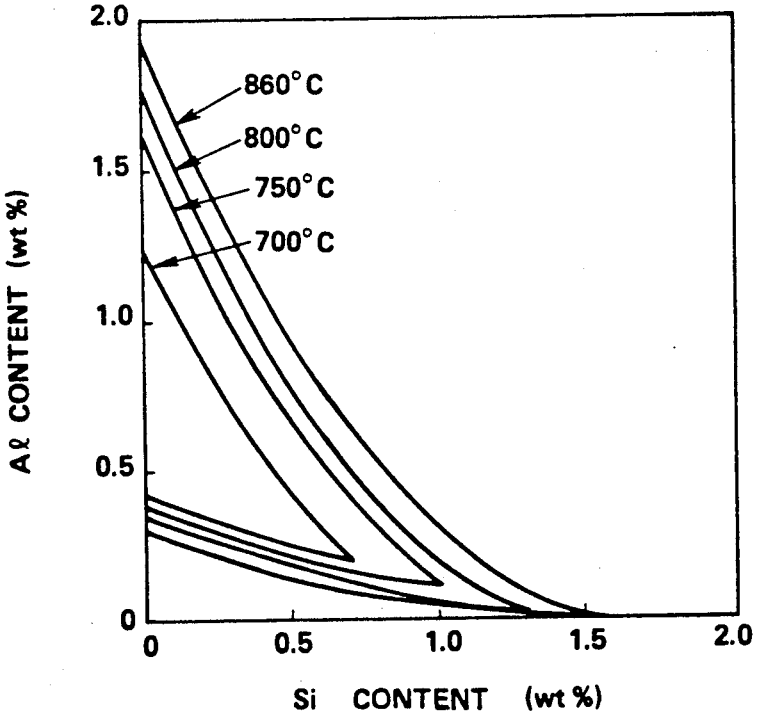
FIG. 4 is a graphic representation showing the Si-Al composition area of the present invention where the austenite structure exists stably at 860°, 800°, 750° and 700° C.

Furthermore, in accordance with the method of the present invention, steel ingots containing the aforementioned compositions are slabbed, thereafter hot rolled at a finishing temperature of 700° to 900° C. into hot rolled steel strips to coil the hot-rolled steel strips at a temperature of 650° C. and more, and then the hot-rolled steel strips are cold-rolled into cold-rolled steel strips, and followed by annealing the cold-rolled steel strips. In order to reduce the disadvantage of grain coarsening in the process to follow due to AlN being melted at a slab reheating process and being precipitated again after hot coiling, the coiling is completed at 650° C. and more to coarsen AlN grain size. Moreover, the lower limit of temperature is set to the lowest temperature where an austenite phase is stable in response to each of Al-Si compositions as shown in FIG. 4 because the stable area of austenite phase is changeable, as shown in FIG. 4, depending on Al-Si compositions during hot working.

EXAMPLE

Steel slabs having chemical compositions as shown in Table 1 were heated in a heating furnace, and, thereafter, hot-rolled into 2.0 mm hot-rolled steel strips in thickness to coil hot-rolled steel strips.

Figure 5:
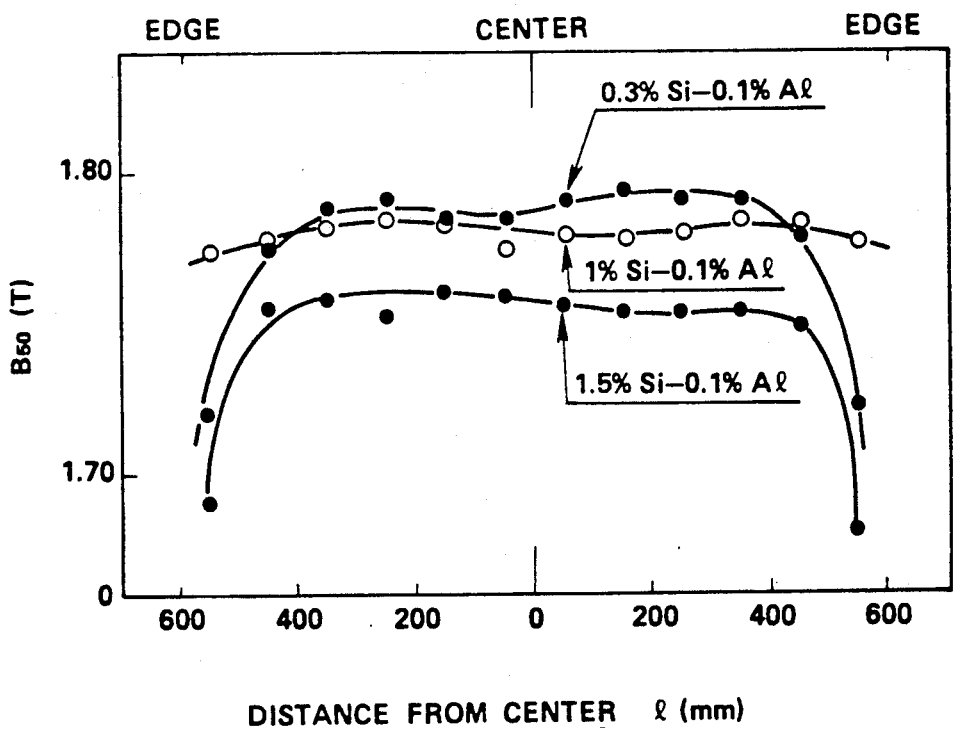
FIG. 5 is a graphic representation showing the distribution of $B_{50}$ in breadth direction of test pieces taken from an example of the present invention.

After acid pickling, the hot-rolled steel strips were reduced through cold rolling to 0.5 mm cold-rolled steel strips in thickness. The cold-rolled strips were continuously annealed at 850° C. for 2 minutes. $B_{50}$ and $W_{15/50}$ of these annealed cold-rolled steel strips are shown in Table 2. Distribution of $B_{50}$ is shown in FIG. 5. $W_{15/50}$ shows core loss at a frequency of 50 c/sec. and at the maximum magnetic flux density of 1.5 T. $B_{50}$ shows magnetic flux density (T) at a magnetizing force of 5000 A/m. Symbol mark ● in FIG. 5 shows controllers of 0.3 wt. % Si-0.1 wt. % Al and 1.5 wt. % Si-0.1 wt. % Al, and symbol mark 0 shows an example of 1 wt. % Si-0.1 wt. % Al according to the present invention. On these terms, controllers showed a remarkable drop of $B_{50}$ at edge portions of the cold-rolled steel strips. This is because the magnetic property of the edge portions were deteriorated, owing to the edge portions having been hot-rolled in the state of being of a ferrite-austenite dual phase. On the contrary, due to $Ar_3$ transformation temperatures dropping, the examples of the present invention allowed hot rolling of the steel slabs of a single austenite phase on the whole breadth, and showed uniformity of $B_{50}$.

Figure 6:
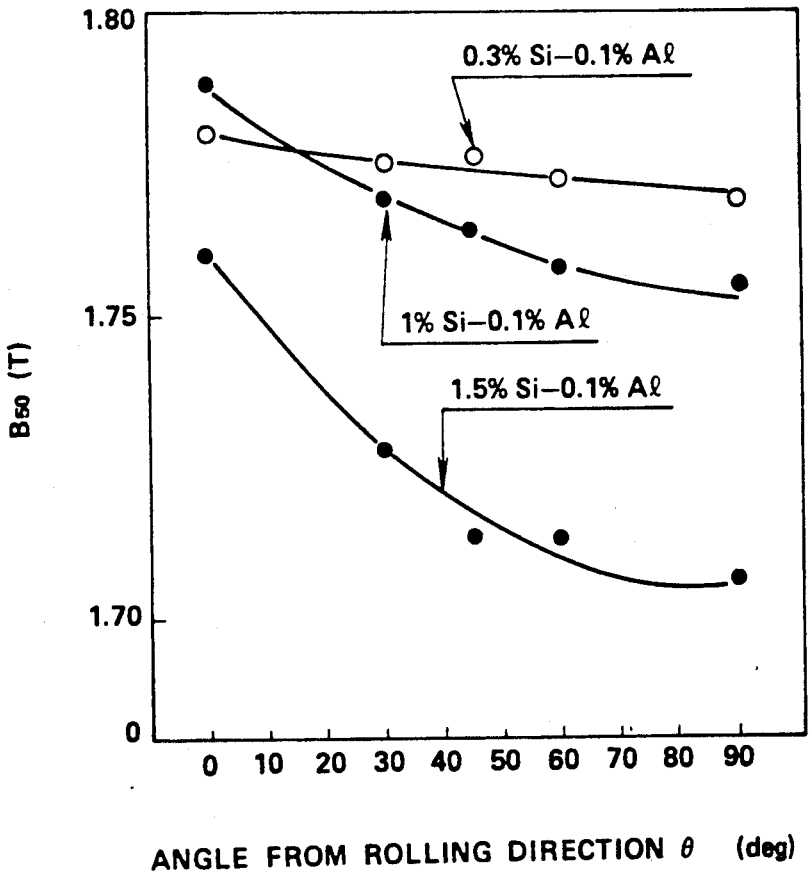
FIG. 6 is a graphic representation showing the influence of plane anisotropy of test pieces taken from an example of the present invention on $B_{50}$.

FIG. 6 shows the influence of plane anisotropy on $B_{50}$. Symbol mark ● in FIG. 5 shows controllers of 0.3 wt. % Si-0.1 wt. % Al and 1.5 wt. % Si-0.1.wt. % Al, and symbol mark O shows an example of 1 wt. % Si-0.1 wt. % Al according to the present invention. All the controllers increase reduction of $B_{50}$ as the angle formed in relation to the rolling direction is increased. The examples of the present invention show reduction at the vicinity of 0.01 T, the plane anisotropy being very small.

Secondly, the magnetic property of Example No. 4 of the present invention having the composition as shown in Table 1 is shown in Table 3, in the case that Example No. 4 was hot-rolled at finishing temperatures of 870° C. and 950° C., respectively. Magnetic property even in the case of a finishing temperature of 870° C. which is within the scope of the present invention and a finishing temperature of 950° C. which is conventionally practiced have almost no difference. In addition, a core loss $W_{15/50}$ of the present invention is improved in comparison with that of a conventional method. This is because ferrite grain size became fine and uniform after hot rolling, due to low temperature rolling.

TABLE 1

| No. | | (wt %) C | Si | Mn | P | S | Sol.Al | N |
|---|---|---|---|---|---|---|---|---|
| Examples | 1 | 0.0021 | 0.31 | 0.18 | 0.002 | 0.005 | 0.412 | 0.0020 |
| | 2 | 0.0024 | 0.29 | 0.18 | 0.002 | 0.006 | 0.867 | 0.0024 |
| | 3 | 0.0024 | 0.72 | 0.17 | 0.003 | 0.005 | 0.420 | 0.0023 |
| | 4 | 0.0021 | 1.01 | 0.18 | 0.002 | 0.005 | 0.102 | 0.0029 |
| Controllers | 5 | 0.0021 | 0.32 | 0.18 | 0.003 | 0.005 | 0.110 | 0.0021 |
| | 6 | 0.0022 | 0.71 | 0.18 | 0.002 | 0.006 | 1.203 | 0.0025 |
| | 7 | 0.0023 | 1.42 | 0.18 | 0.002 | 0.006 | 0.431 | 0.0022 |
| | 8 | 0.0023 | 1.53 | 0.17 | 0.002 | 0.005 | 0.112 | 0.0024 |

TABLE 2

| | No. | $B_{50}$ (T) | $W_{15/20}$ (W/kg) |
|---|---|---|---|
| Examples | 1 | 1.78 | 4.73 |
| | 2 | 1.77 | 4.62 |
| | 3 | 1.78 | 4.71 |
| | 4 | 1.78 | 4.87 |
| Controllers | 5 | 1.78 | 5.92 |
| | 6 | 1.75 | 5.58 |

TABLE 2-continued

| No. | $B_{50}$ (T) | $W_{15/20}$ (W/kg) |
|---|---|---|
| 7 | 1.75 | 5.49 |
| 8 | 1.76 | 5.53 |

TABLE 3

| | Example | Controller |
|---|---|---|
| Finishing temperature | 870° C. | 950° C. |
| $B_{50}$ (T) | 1.78 | 1.79 |
| $W_{25/50}$ (W/kg) | 4.87 | 5.35 |

What is claimed is:

1. A method for producing a non-oriented electrical steel sheet with precise thickness and homogeneous magnetic property comprising the steps of:

providing a steel slab which has:

0.01 wt. % or less C, 0.003 wt. % or less N, 0.1 to 1.0 wt. % Mn,

Al and Si satisfying in wt. % the formulas of:

$$(Al\ \%) \leqq 0.69\ (Si\ \%)^2 - 2.29\ (Si\ \%) + 1.90;$$

$$(Al\ \%) \geqq 0.10\ (Si\ \%)^2 - 0.35\ (Si\ \%) + 0.3;$$

$$0 \leqq (Si\ \%) \leqq 1.7\ wt.\ \%;\ and\ (Al\ \%) \geqq 0$$

provided that (Si %) represents the Si content in wt. % and (al %) represents the Al content in wt. % and the balance being Fe and inevitable inpurities;

hot-rolling the slab at a finishing temperature of 700° C. to 900° C. into a steel strip, coiling the hot rolled strip; and cold-rolling the hot-rolled strip into a cold-rolled strip, and annealing the cold rolled strip.

2. The method of claim 1, wherein said finishing temperature is between 860° C. to an $Ar_3$ transformation point when the steel is not worked.

3. The method of claim 1, wherein the contents of Si and Al satisfy the formulas of:

$$(Al\ \%) \leqq 0.82\ (Si\ \%)^2 - 2.39\ (Si\ \%) + 1.76$$
$$(Al\ \%) \geqq 0.15\ (Si\ \%)^2 - 0.46\ (Si\ \%) + 0.36$$
$$(Si\ \%) \leqq 1.3\ wt.\ \%,$$

and said finishing temperature is between 800° C. to an $Ar_3$ transformation point when the steel slab is not worked.

4. The method of claim 1, wherein the contents of Si and Ai satisfy the formulas of:

$$(Al\ \%) \leqq 0.80\ (Si\ \%)^2 - 2.28\ (Si\ \%) + 1.60$$
$$(Al\ \%) \geqq 0.18\ (Si\ \%)^2 - 0.46\ (Si\ \%) + 0.38$$
$$(Si\ \%) \leqq 1.0\ wt.\ \%,$$

and said finishing temperature is between 750° C. to an $Ar_3$ transformation point when the steel slab is not worked.

5. The method of claim 1, wherein the contents of Si and Al satisfy the formulas of:

$$(Al\ \%) \leqq 0.92\ (Si\ \%)^2 - 2.14\ (Si\ \%) + 1.25$$

-continued $$(Al\ \%) \geqq 0.10\ (Si\ \%)^2 - 0.40\ (Si\ \%) + 0.43$$
$$(Si\ \%) \leqq 0.7\ wt.\ \%,$$

and said finishing temperature is between 700° C. to an $Ar_3$ transformation point when the steel slab when the steel slab is not worked.

6. The method of claim 1, wherein the steel slab has the following composition:

| |
|---|
| 0.0021 wt. % C |
| 0.31 wt. % Si |
| 0.18 wt. % Mn |
| 0.412 wt. % Al. |

the balance being Fe and inevitable impurities.

7. The method of claim 1, wherein the steel slab has the following composition:

| |
|---|
| 0.0024 wt. % C |
| 0.29 wt. % Si |
| 0.18 wt. % Mn. |

the balance being Fe and inevitable impurities.

8. The method of claim 1, wherein the steel slab has the following composition:

| |
|---|
| 0.002 wt. % C |
| 0.72 wt. % Si |
| 0.17 wt. % Mn |

-continued

| |
|---|
| 0.42 wt. % Al. |

the balance being Fe and inevitable impurities.

9. The method of claim 1, wherein the steel slab has the following compositions:

| |
|---|
| 0.0021 wt. % C |
| 1.01 wt. % Si |
| 0.18 wt. % Mn |
| 0.102 wt. % Al. |

the balance being Fe and inevitable impurities.

10. The method of claim 1, wherein the annealing is conducted at a temperature of 850° C. for 2 minutes.

11. The method of claim 10, wherein the finishing temperature is 870° C.

Figure 1:
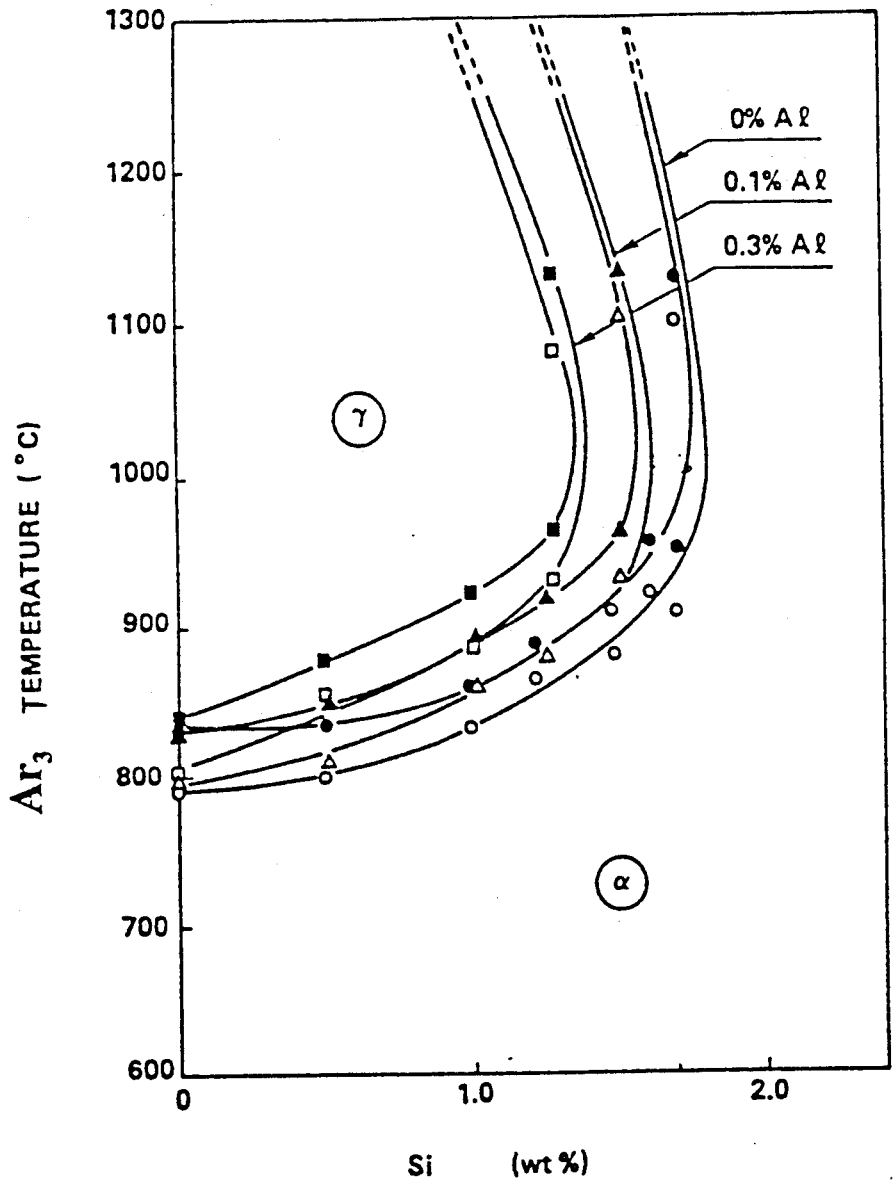
FIG. 1 PRIOR ART
FIG. 1 is a phase diagram of Fe-Si steel of a prior art.

12. The method of claim 2, wherein the $Ar_3$ transformation point when the steel is not worked is determined from the (Si %), (Al %) and $Ar_3$ temperature relationships depicted in FIG. 1.

13. The method of claim 3, wherein the $Ar_3$ transformation point when the steel is not worked is determined from the (Si %), (Al %) and $Ar_3$ temperature relationships depicted in FIG. 1.

14. The method of claim 4, wherein the $Ar_3$ transformation point when the steel is not worked is determined from the (Si %), (Al %) and $Ar_3$ temperature relationship depicted in FIG. 1.

15. The method of claim 5, wherein the $Ar_3$ transformation point when the steel is not worked is determined from the (Si %), (Al %) and $Ar_3$ temperature relationships depicted in FIG. 1.

* * * * *